US005829626A

United States Patent [19]

Brennan

[11] Patent Number: 5,829,626

[45] Date of Patent: Nov. 3, 1998

[54] STADIUM SIMULATING BOWL

[75] Inventor: Raymond Brennan, Pittsburgh, Pa.

[73] Assignee: Stadium Bowls, Inc., Pittsburgh, Pa.

[21] Appl. No.: 837,260

[22] Filed: Apr. 10, 1997

[51] Int. Cl.[6] ..... B65D 3/00

[52] U.S. Cl. ..... 220/574; D7/584

[58] Field of Search ..... 220/574, 575, 220/662; D7/506, 563, 564, 560, 551.1, 584

[56] References Cited

U.S. PATENT DOCUMENTS

| | | | |
|---|---|---|---|
| D. 351,531 | 10/1994 | Brennan | D7/584 |
| 2,150,910 | 3/1939 | Chaplin | 220/574 X |
| 2,213,837 | 9/1940 | Gill | 220/575 |
| 3,734,077 | 5/1973 | Murdough et al. | D7/584 X |
| 3,916,872 | 11/1975 | Kreis et al. | D7/584 X |
| 4,106,658 | 8/1978 | Brandon | 220/574 |

*Primary Examiner*—Steven M. Pollard
*Attorney, Agent, or Firm*—William L. Krayer

[57] ABSTRACT

A stadium simulating bowl comprises a base shell, a transparent cover shell and an illustrated flat cut in a shape so that it will substantially entirely cover the base shell. The base shell, with the illustrated flat appropriately creased on top of it nests into the cover shell, which is welded peripherally around the base of the two shells. The flat includes a rectangular central area and four arms, each having two trapezoidal and one generally rectangular areas.

7 Claims, 4 Drawing Sheets

STADIUM SIMULATING BOWL

TECHNICAL FIELD

This invention relates to bowls, particularly bowls of three or more pieces assembled to display printed or other informational matter over substantially the entire area of the bowl.

BACKGROUND OF THE INVENTION

My Design Patent Des. 351,531, issued Oct. 18, 1994 and entitled "Stadium Simulating Transparent Bowl" discloses a design for a transparent bowl. FIG. 4 shows a section of the bowl, which reveals that the bowl is made from complementary upper and lower shells. A space is provided between the flat centers of the shells to accommodate an "illustrative label" which forms no part of the design.

The bowl in Des. 351,531 will not accommodate an illustrative label more complex than a simple flat sheet for placing between the bottom or central portions of the shells. Placing illustrations on the balance of the available surface area of the bowl would be difficult both because space is not provided between the shells except on the bottom, and because of the vertical and horizontal curvatures of the surfaces.

SUMMARY OF THE INVENTION

I have invented a stadium-simulating bowl which is free of the above-mentioned shortcomings, in that decorative or illustrative material may be placed to be visible anywhere on its surface conveniently and accurately. My bowl comprises a formed transparent cover shell, a complementary base shell and at least one illustrated member for placing between the shells. The shells have a generally rectangular shape with raised sides and the primary illustrated member has a perimeter such that, on creasing, it will rest in the base shell and cover at least the entire interior of the base shell.

My bowl is especially suited for cereals and soups.

DETAILED DESCRIPTION OF THE INVENTION

My bowl has at least three components—a base shell, a cover shell, and at least one creased or creasable illustrated flat. The bowl is assembled by creasing the illustrated flat on all four sides of a generally rectangular central portion, placing the central portion in the correspondingly sized central portion of the base shell, and creasing the side and end flaps to conform to and cover substantially the entire base shell, preferably including its outer vertical sides. The cover shell is then placed on top of the flat now conforming to the shape of the base shell, and the two shells are welded around their bottom periphery. The bowl thus constructed is leakproof and displays the illustration in a simulated three-dimensional manner.

BRIEF DESCRIPTION OF THE DRAWINGS

Referring now to FIG. 1, the bowl 1 is seen to be of generally rectangular shape, having a recess 2 formed by sides 3*a*, 3*b*, 3*c*, and 3*d* of cover shell 8 which open outwardly. Sides 3*a*, 3*b*, 3*c*, and 3*d* and floor 4 of cover shell 8 are transparent, permitting a full view of the illustrated flat 5. The outwardly opening angle of sides 3*a*, 3*b*, 3*c*, and 3*d* in FIG. 1 is about 60° from the horizontal, but may vary from about 45° to about 80°, and in fact need not be continuous but may proceed upwardly in levels or steps, although levels or steps representing tiers of a stadium may require additional creasing and more meticulous design for the illustrated flat 5. The overall impression of bowl 1 as conveyed particularly by the illustrated flat 5 is to provide the appearance of a football stadium, but any design may be used for the illustrated flat 5 such as, for example, a soccer stadium, a hockey rink, a basketball court, or other athletic or entertainment arena.

Figure 2A:
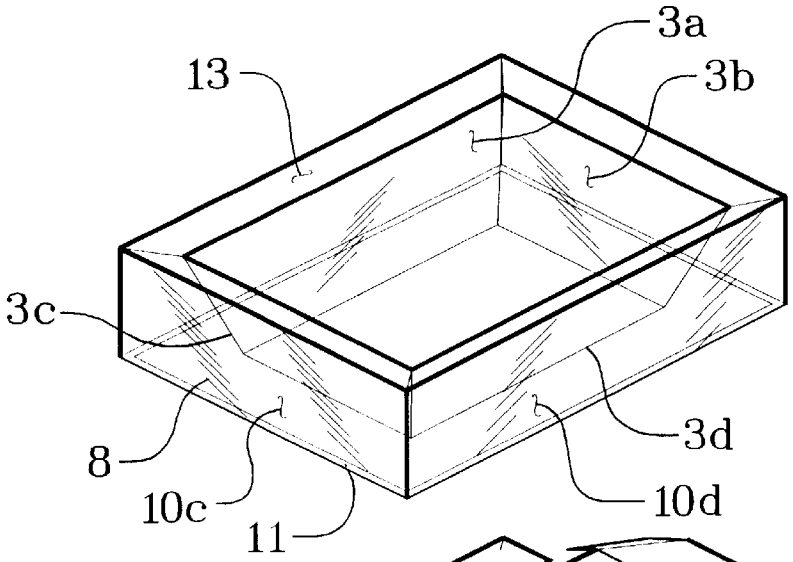
FIGS. 2*a*, 2*b*, and 2*c* show the three major elements of the bowl in a more or less exploded juxtaposition.

The cover shell 8 depicted in FIG. 2*a* is transparent so the illustrations on the illustrated flat 5 (FIG. 2*b*) may be easily seen. Vertical outer sides 10*c* and 10*d* have a thickness of about equal to or slightly less than the width of flange 7 on base shell 6 (FIG. 2*c*) and a height sufficient to permit bottom periphery 11 to rest on flange 7 (FIG. 2*c*) of base shell 6 while still providing a snug fit for peripheral top surface 12 of the base shell 6 (FIG. 2*c*) on the underside of peripheral top surface 13 of the cover shell 8. Overall, the dimensions of base shell 6 and cover shell 8 are such that base shell 6 will fit snugly, or nest, within cover shell 8 while leaving space for the appropriately creased or folded illustrated flat 5.

Figure 2B:
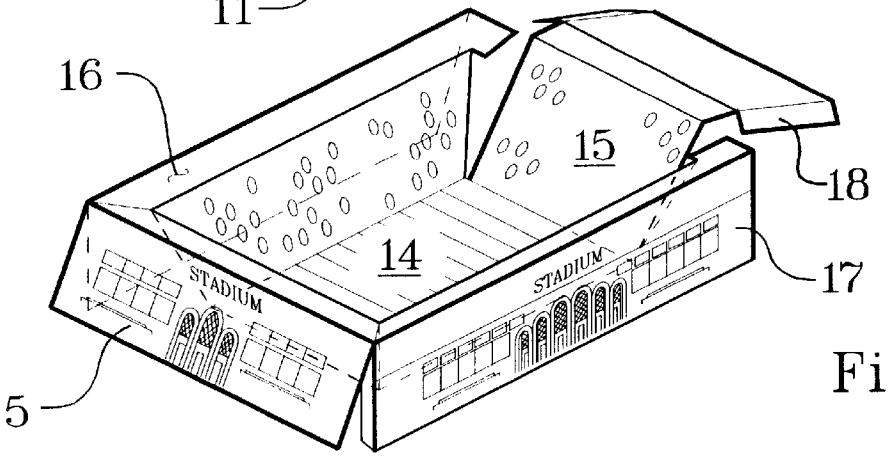

In FIG. 2*b*, the illustrated flat 5 is seen to have a rectangular central area 14, outwardly extending arms 15, elevated areas 16, putative vertical areas 17, and sealing ends 18. Illustrated flat 5 is further described in FIG. 3.

Figure 1:
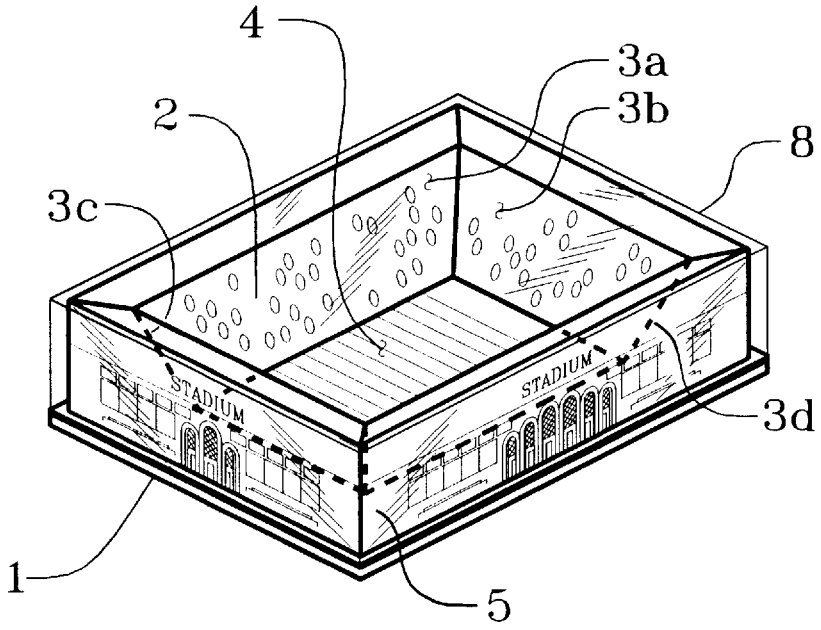
FIG. 1 is a perspective view of the finished bowl, showing the visibility of the illustrations.
Figure 2C:
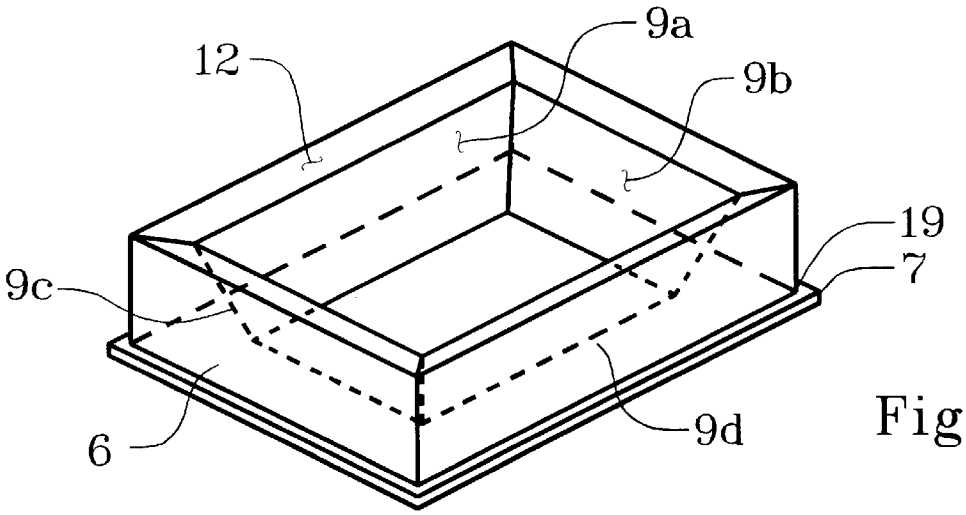

FIG. 2*c* is the base shell 6. The base shell 6 may be opaque and is preferably formed with a peripheral bottom flange 7 at the terminus of peripheral vertical wall 19; the cover shell 8 (FIG. 2*a*) may thus rest on bottom flange 7. Base shell 6 is not visible in FIG. 1, being completely covered (except the outer edge of flange 7) by the preferred illustrated flat 5 of FIG. 2*b*. Base shell 6 is generally of the same shape as cover shell 8 of FIG. 2*a*; sides 9*a*, 9*b*, 9*c*, and 9*d* are complementary to sides 3*a*, 3*b*, 3*c*, and 3*d* of cover shell 8 (FIG. 2*a*) so that they will fit into them snugly, permitting space for illustrated flat 5. The angles of sides 9*a*, 9*b*, 9*c*, and 9*d* should be equal to the angles of sides 3*a*, 3*b*, 3*c*, and 3*d* of cover shell 8. Peripheral top surface 12 is of a width less than the width of peripheral top surface 13 of cover shell 8 (FIG. 2*a*).

Figure 3:
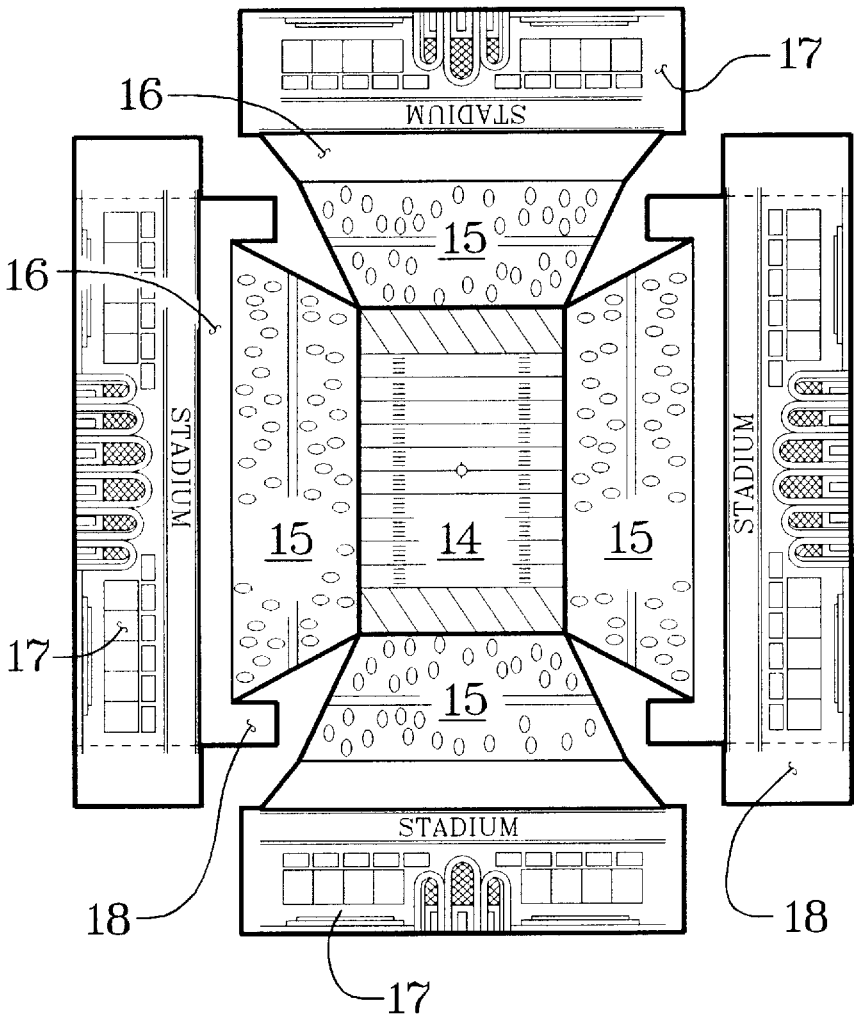
FIG. 3 depicts a preferred illustrated flat prior to creasing for insertion in the bowl.

Referring now to FIG. 3, which shows the illustrated flat, a critical point is that the outwardly extending arms 15 are cut in generally trapezoidal shapes to fit on sides 9*a*, 9*b*, 9*c*, and 9*d* of base shell 6 (see FIG. 2*c*) . Likewise the shapes of elevated areas 16 are cut to fit the top surface 12 of base shell 6, also in trapezoidal shapes (to which are appended sealing ends 18) and putative vertical areas 17 will fit on peripheral vertical wall 19 of base shell 6.

Cutting the trapezoidal extending arms 15 to the shapes of sides 3*a*, 3*b*, 3*c*, and 3*d*, and the elevated areas 16 to the shapes of the peripheral surface 12 of the base shell 6 will assure that there will be no uncovered areas on the inside portions of the bowl; such a cut would not define sealing ends 18, which may be considered optional although one may wish to assure that the properly creased flat will come together at all the intersections of the bowl when it is assembled, so that the complete illustration is seen without any cracks. Likewise the vertical areas 17 should conform to the shapes of the peripheral vertical wall 19, in order for the entire bowl to be suitably illustrated; this means taking into account a desirable slight flaring of vertical walls 19 to facilitate nesting. Vertical areas 17 may therefore be slightly trapezoidal rather than exactly rectangular. I sometimes refer to such shapes as "generally rectangular". Sealing ends 18 are placed underneath the adjacent illustrated or stadium-simulating elevated areas 16 or 17 for gluing.

Figure 4A:
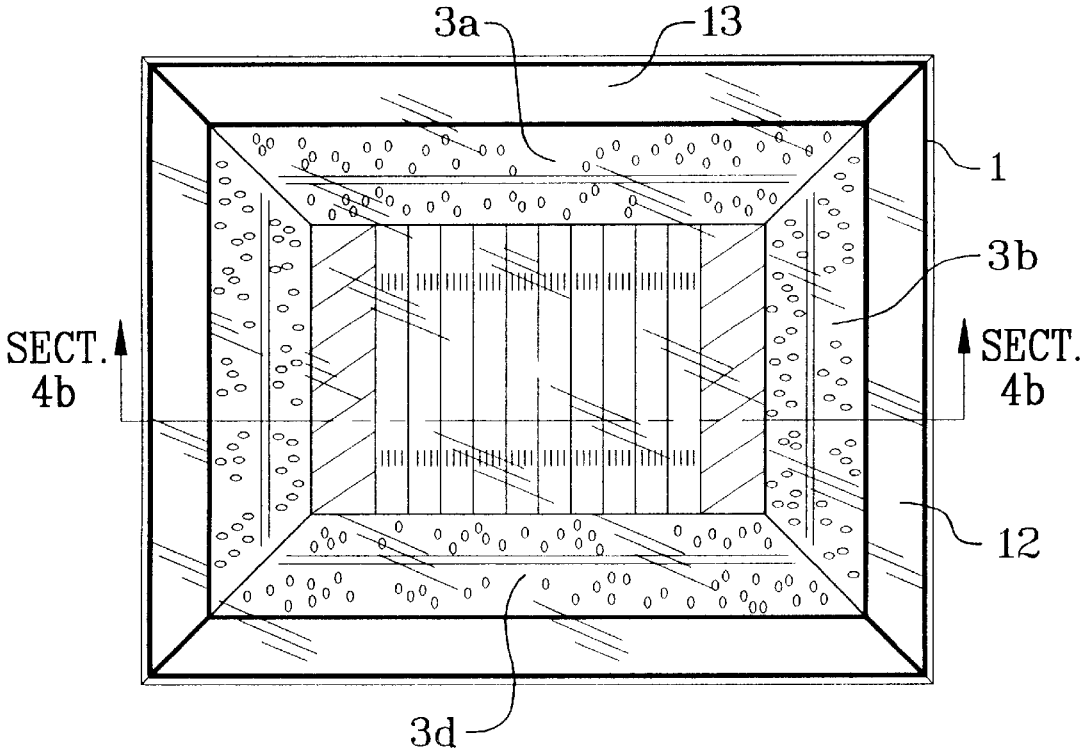
FIG. 4*a* is an overhead view of the finished bowl and FIG. 4*b* is a section of the assembled bowl showing the weld.
Figure 4B:
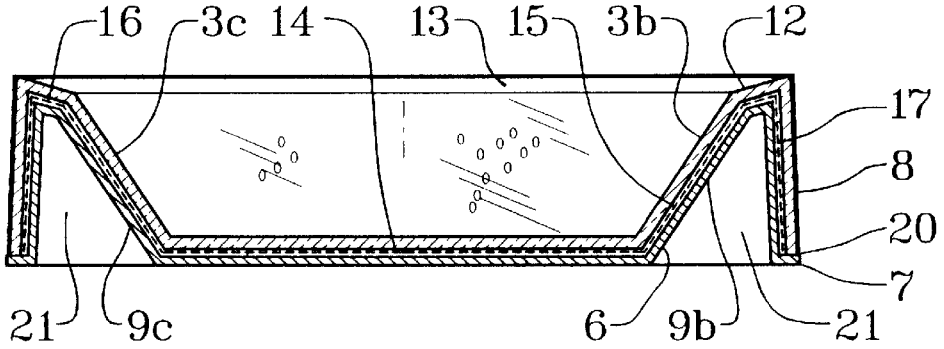

Referring now to FIGS. 4*a* and 4*b*, the section through the bowl shows a weld 20 at the junction of flange 7 of base shell 6 and cover shell 8. The weld 20 may be accomplished by any commercially proven sonic or other welder for welding plastic materials. Vertical areas 17, elevated areas 16, outwardly extending arms 15, and central area 14 of the illustrated flat 5 are seen to be situated between the base shell 6 and cover shell 8. Sides 3*c* and 3*b* of the cover shell 8 and sides 9*c* and 9*b* of the base shell 6, together with top surface 12 of the base shell 6 and top surface 13 of the cover shell 8 and vertical areas 17 form an inverted U channel 21 which preferably flares slightly outwardly for ease of nesting. As mentioned above in reference to FIG. 2*c*, top surface 12 is of a narrower width than top surface 13; hence the inverted U channel is formed by a slightly larger U channel in cover shell 8 and a slightly smaller U channel in cover shell 6.

Thus it will be seen that my invention is a bowl comprising (a) a base shell of a generally rectangular shape having a generally flat central area, four outwardly extending sides and an inverted U periphery, (b) an illustrated flat creased to conform to the shape of said base shell, and (c) a transparent cover shell of a generally rectangular shape dimensioned to nest over said base shell while leaving space extending over said central area, said outwardly extending sides, and said inverted U periphery, for said creased illustrated flat, said base shell and said cover shell being welded together peripherally.

More particularly, my invention is a bowl comprising (a) a base shell of a generally rectangular shape having a generally flat central area, four outwardly extending sides and an inverted U periphery, (b) an illustrated flat creased to conform to the shape of said base shell, said illustrated flat including (i) two end arms, each of said end arms comprising a trapezoidal base, a trapezoidal central area attached to said trapezoidal base, and a generally rectangular terminus attached to said trapezoidal central area, and (ii) two side arms, each of said side arms comprising a trapezoidal base, a central area attached to said trapezoidal base and having a sealing flap on each end, and a terminal area attached to said central area and having a sealing flap on each end, and (c) a transparent cover shell of a generally rectangular shape dimensioned to nest over said base shell while leaving space extending over said central area, said outwardly extending sides, and said inverted U periphery, for said creased illustrated flat, said base shell and said cover shell being welded together peripherally, preferably at a peripheral flange on said base shell.

The cover shell 8 and base shell 6 may be made of a thermosetting material or a thermoplastic for convenient manufacture, preferably a polycarbonate or one of the polyethylene terephthalates or related copolymers which are FDA approved and suitable for use in automatic dishwashers. A suitable material is KODAR, a PETG made by Eastman Chemical Company; however, any thermosetting or thermoformable synthetic resin which is FDA approved for eating utensils and which is approved for automatic dishwashers may be used. Since the base shell 6 may be opaque, it may contain significant amounts of fillers such as calcium carbonate and other well-known pigments and fillers.

Ordinary paper and glue may be used for the illustrated flat; whatever the materials, the flat, the glue and the ink used for the illustration should be FDA approved or otherwise suitable for use with food and for withstanding dishwasher conditions.

I claim:

1. A bowl comprising (a) a base shell of a generally rectangular shape having a generally flat central area, four outwardly extending sides and an inverted U periphery, (b) an illustrated flat creased to conform to the shape of said base shell, and (c) a transparent cover shell of a generally rectangular shape dimensioned to nest over said base shell while leaving space extending over said central area, said outwardly extending sides, and said inverted U periphery, for said creased illustrated flat, said base shell and said cover shell being welded together peripherally.

2. A bowl of claim 1 wherein said illustrated flat has four outwardly extending arms.

3. A bowl of claim 1 wherein said illustrated flat has two end arms and two side arms, each of said end arms and said side arms comprising a trapezoidal base, a trapezoidal central area attached to said trapezoidal base, and a generally rectangular terminus attached to said trapezoidal central area.

4. A bowl of claim 1 wherein said illustrated flat includes (a) two end arms, each of said end arms comprising a trapezoidal base, a trapezoidal central area attached to said trapezoidal base, and a generally rectangular terminus attached to said trapezoidal central area, and (b) two side arms, each of said side arms comprising a trapezoidal base, a central area attached to said trapezoidal base and having a sealing flap on each end, and a terminal area attached to said central area and having a sealing flap on each end.

5. A bowl of claim 1 wherein said inverted U periphery of said base shell includes a peripheral flange, and wherein said cover shell and said flange are welded together.

6. A bowl of claim 1 wherein said outwardly extending sides open outwardly at an angle from about 45° to about 80° from the horizontal.

7. A bowl comprising (a) a base shell of a generally rectangular shape having a generally flat central area, four outwardly extending sides and an inverted U periphery terminating in an outwardly extending flange, (b) an illustrated flat creased to conform to the shape of said base shell, said illustrated flat including (i) two end arms, each of said end arms comprising a trapezoidal base, a trapezoidal central area attached to said trapezoidal base, and a generally rectangular terminus attached to said trapezoidal central area, and (ii) two side arms, each of said side arms comprising a trapezoidal base, a central area attached to said trapezoidal base and having a sealing flap on each end, and a terminal area attached to said central area and having a sealing flap on each end, and (c) a transparent cover shell of a generally rectangular shape dimensioned to nest over said base shell while leaving space extending over said central area, said outwardly extending sides, and said inverted U periphery, for said creased illustrated flat, said base shell and said cover shell being welded together peripherally at said outwardly extending flange on said base shell.

* * * * *